US006592129B1

(12) United States Patent
Gates

(10) Patent No.: US 6,592,129 B1
(45) Date of Patent: Jul. 15, 2003

(54) PAIR OF WHEELED SKATE-SKIS WITH BRAKES USABLE ON MOST TERRAINS

(76) Inventor: Patrick G Gates, 4155 Kimberly St., Richland, WA (US) 99352

( * ) Notice: Subject to any disclaimer, the term of this patent is extended or adjusted under 35 U.S.C. 154(b) by 0 days.

(21) Appl. No.: 09/626,672

(22) Filed: Jul. 27, 2000

(51) Int. Cl.[7] ..... A63C 17/06; A63C 17/14; F16D 51/24

(52) U.S. Cl. ..... 280/11.204; 280/11.212; 280/11.233; 280/11.25; 188/336

(58) Field of Search ..... 280/11.212, 11.233, 280/11.19, 11.25, 11.204; 188/336, 337, 338, 364

(56) References Cited

U.S. PATENT DOCUMENTS

| | | | | | |
|---|---|---|---|---|---|
| 1,772,564 | A | * | 8/1930 | Preston | 280/842 |
| 1,801,230 | A | * | 4/1931 | Fehre | 280/842 |
| 1,855,485 | A | * | 4/1932 | Moore | 188/336 |
| 2,149,651 | A | * | 3/1939 | White | 188/336 |
| 2,377,277 | A | * | 5/1945 | Stelzer | 188/336 |
| 2,497,815 | A | * | 2/1950 | Frick | 188/336 |
| 3,749,413 | A | * | 7/1973 | Nicolson | 280/842 |
| 3,767,220 | A | * | 10/1973 | Peterson | 280/842 |
| 3,853,207 | A | * | 12/1974 | Rist | 188/336 |
| 3,926,449 | A | * | 12/1975 | Wilje | 280/842 |
| 4,141,437 | A | * | 2/1979 | Roberts | 188/336 |
| 4,637,499 | A | * | 1/1987 | Rupprecht | 188/336 |
| 4,943,075 | A | * | 7/1990 | Gates | 280/842 |
| 5,251,934 | A | * | 10/1993 | Gates | 280/842 |
| 5,286,043 | A | * | 2/1994 | Tkaczyk | 280/842 |
| 5,312,120 | A | * | 5/1994 | Wiegner | 280/842 |
| 5,398,950 | A | * | 3/1995 | Tkaczyk | 280/842 |
| 5,584,491 | A | * | 12/1996 | Kronyak, Jr. | 280/11.2 |
| 5,704,617 | A | * | 1/1998 | Stoughton et al. | 280/11.2 |
| 5,901,981 | A | * | 5/1999 | Lucht | 280/842 |
| 6,116,619 | A | * | 9/2000 | Kao et al. | 280/11.19 |
| 6,139,035 | A | * | 10/2000 | Tsai | 280/87.041 |
| 6,186,294 | B1 | * | 2/2001 | Maehara | 188/336 |

* cited by examiner

*Primary Examiner*—Brian L. Johnson
*Assistant Examiner*—Jeffrey Restifo
(74) *Attorney, Agent, or Firm*—Roy E. Mattern, Jr.

(57) ABSTRACT

Improvements made to wheeled skate-skis with brakes usable on most terrains are: a hand controlled hydraulic fluid braking assembly, having a sole, resilient, curved spring, brake shoe, providing performance in comparison with the braking performance of a roadway motor vehicle; a chassis with a foot receiving body portion formed on a convex camber and made of materials which are flexible, under the weight of a person, thereby providing a spring like suspension, and with upwardly directed curved forked ends to position wheel axles higher above the ground to lower the foot receiving body portion, to thereby lower the center of gravity of the sportsperson, while moving on the wheeled skate-skis; a binding which is a combination of an outer shell of a firm material and an inner liner of soft material, which together are adjustable to fit different sizes and types of athletic shoes selected and worn by sportspersons; and a removable mud flap supportable on the binding to deflect water and/or debris thrown by a rear wheel.

7 Claims, 6 Drawing Sheets

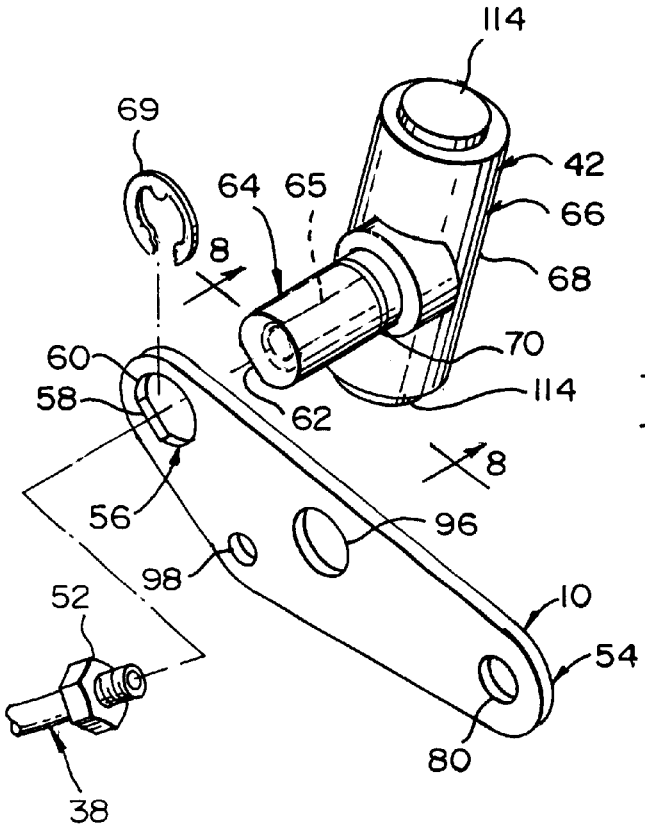
FIG. 7
FIG. 8
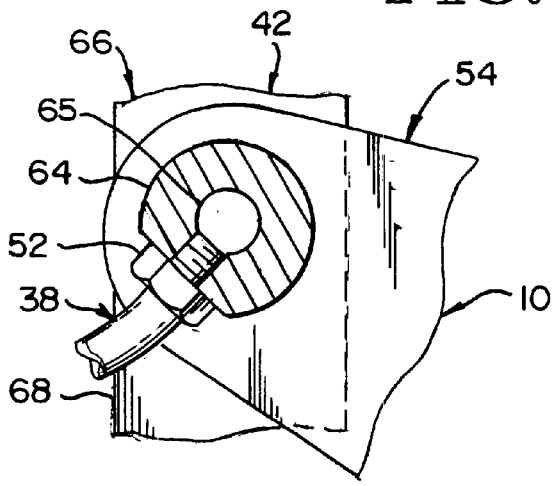

FIG. 11
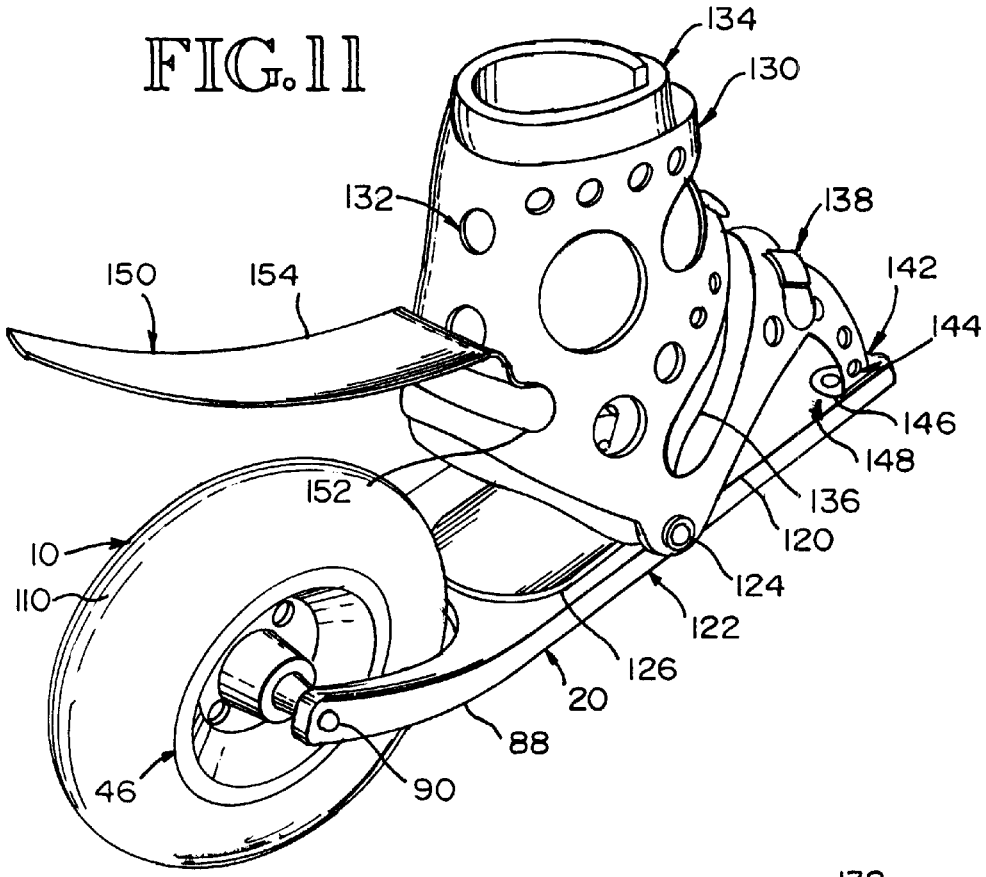
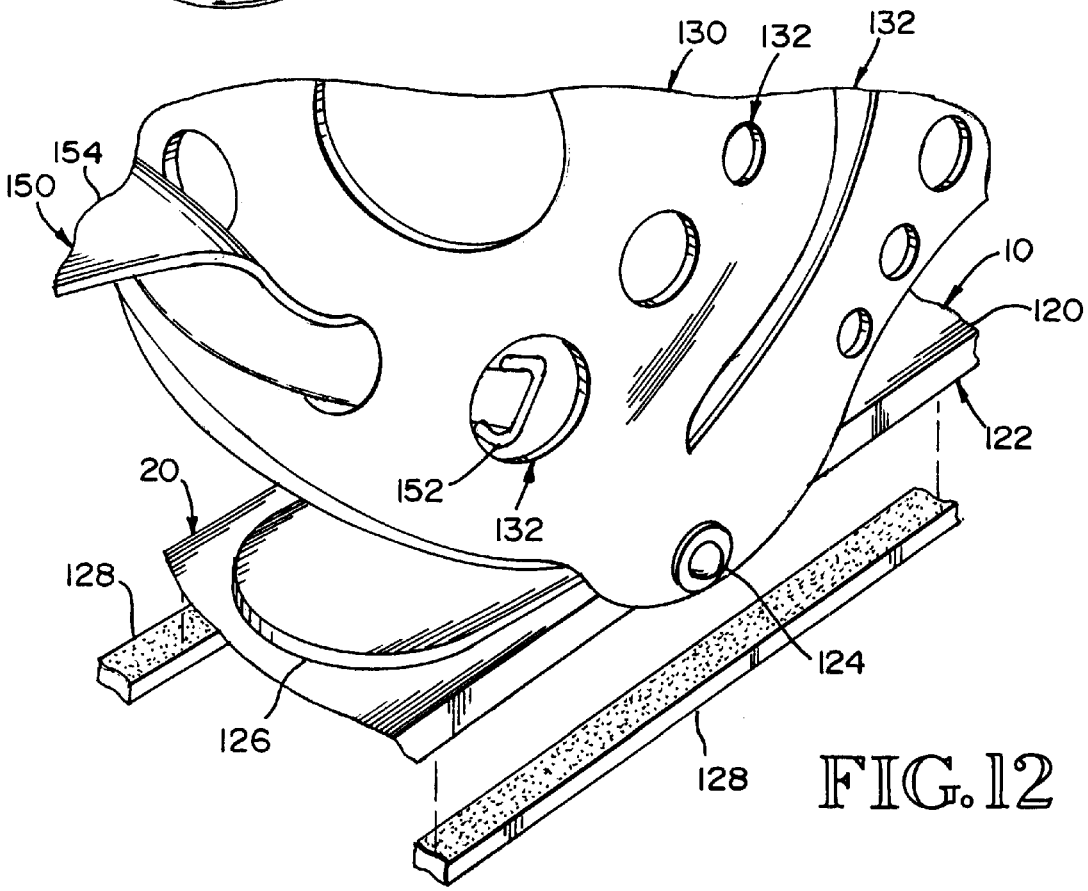
FIG. 12

PAIR OF WHEELED SKATE-SKIS WITH BRAKES USABLE ON MOST TERRAINS

CROSS REFERENCES

This application concerns improvements of a pair of wheeled skate-skis with brakes usable on most terrains, and the applicant is Patrick G. Gates, who is the patentee of his two U.S. Pat. Nos. 4,943,075, and 5,251,934. The information set forth in these patents, pertains to his earlier pairs of wheeled skate-skis with brakes usable on most terrains. The information in these patents is incorporated into this application by reference.

BACKGROUND

In some similar respects to using side by side water skis, and snow skis, side by side wheeled skis have been and are being used for travel over land.

In 1973, Robert A. Peterson, in his U.S. Pat. No. 3,767,220 illustrated and described his foot worn two-wheeled vehicle to rollably support one foot of a person, as a like two-wheeled vehicle supported the person's other foot. The person in a standup position, then maneuvered like he or she, would snow-ski on a slope. Each vehicle had a frame supporting a pair of wheels at opposite ends, and shaped so the person's feet are located close to ground level. Toe and heel clamps held the person's respective boots in position on the respective two-wheeled vehicles. A movable calf member was pivotally connected to each heel clamp and it had a braking portion to be moved into braking contact with the inflated rear tire, when the person altered his or her position to move his or her calf to thereby apply the brakes.

Also in 1973, John G. Nicolson, in his U.S. Pat. No. 3,749,413, illustrated and described his wheeled ski. Two of them side by side, were used by a person when skiing over dry land using motions similar to snow skiing. When a person's heel was raised the movement of his or her foot in a shoe pivotally held on on the wheeled ski, moved a linkage, and the a pivot bar thereof impinged on the front wheel to prevent its rotation.

Earlier in 1966, Duane E. Blanchard, in his U.S. Pat. No. 3,365,208, illustrated and described his roller skis, one to be used on each foot, as the person's shoes were respectively held in place by a cable-like binding on each roller ski. His roller skis were said to provide the skier with a high degree of maneuverability similar to using snow skis on snow. However, Duane E. Blanchard's roller skis had no brakes.

In 1990, Patrick G. Gates, in his U.S. Pat. No. 4,943,075, illustrated and described his pair of wheeled skate-skis with brakes usable on most terrains. Then in 1993, in his U.S. Pat. No. 5,251,934, he illustrated and described his improved pair of wheeled skate-skis with brakes usable on most terrains. A person using a pair of these wheeled skate-skis with brakes, having his or her athletic shoes on, has his or her feet well held in surrounding bindings, and with convenient hand controls to operate the brakes, this person is able to travel on most terrains under better control.

SUMMARY

As illustrated and described in his previous U.S. Pat. No. 4,943,075, of 1990 and U.S. Pat. No. 5,251,934 of 1993, Patrick G. Gates provides pairs of wheeled skate-skis with brakes usable on most terrains. He has continued to improve them, so a sportsperson and/or all persons seeking a better way to get around, who selectively enjoy and/or appreciate skating-skiing on level ground, going uphill and/or coasting downhill on various terrains may do so, while better performing their travel functions. They now know they can slow down and/or stop reliably at anytime. They now hand control a hydraulic fluid braking assembly providing performance in comparison with the braking performance of a roadway motor vehicle.

In addition to these hydraulic fluid brakes using brake cylinders, brake shoes, brake linings, and brake drums on the wheels, the person wearing shoes, generally athletic shoes, places his or her feet into respective bindings, which are a combination of an outer shell of firm material and in inner liner of soft material. Both the outer shell and inner liner are adjustable to fit different sizes and types of shoes. By using these bindings, the persons increase their control over the wheeled skate-skis and remain comfortable during their travel time. Generally persons using the Wheeled Skate-Skis continue to use their selected shoes for getting around throughout their entire experience, walking, driving, riding, and perhaps, even running, before and/or after the time they spend traveling on the wheeled skate-skis.

Also the chassis of each wheeled skate-skis has a foot receiving body portion having a built in convex camber to provide a spring-like suspension. The chassis is made of a material which is resilient and capable of returning to its original camber, without a separate spring. Also each chassis has upwardly directed curved forked ends to position the wheel axles higher above the ground. This higher positioning of the wheel axles thereby lowers the overall center of gravity of the person, while she or he is moving on the wheeled skate-skis.

Then when a person is traveling on a rainy weather day, he or she may quickly install snap-on-mud-flaps, for their removable attachment to the outer shell of each binding, to deflect any water and debris away from the backside of the person. Also a person at night, a cloudy time, or anytime, may removably attach a flashing light unit on a belt he or she wears to support the brake control and hydraulic lines. The flashing light gets the attention of drivers of on-coming motor vehicles.

DRAWINGS

These improved pair of wheeled skate-skis with brakes which are usable on most terrains are illustrated in the drawings wherein:

FIG. 1 is a rear perspective view of a sportsperson on the wheeled skate-skis as he or she is ready to begin travel over a terrain, with his or her hand holding the hand control for operating the hydraulic fluid braking system, which will be hand operated, when necessary to apply the braking forces when slowing down or stopping, obtaining a braking performance in comparison with the braking performance of a roadway motor vehicle;

FIG. 2 is a partial side view of a belt when worn by a person on which the hand control for operating the hydraulic fluid braking system may be mounted using a hook and loop fastener;

FIG. 3 is a side view of a wheeled skate-ski having many of the components of the hydraulic fluid braking system, showing the rear wheel having the brake drum, brake shoe, and brake lining assembled with the rear wheel assembly, also showing the binding having the outer shell of firm material and the inner liner of soft material, and in addition, showing the chassis, having a built in convex camber and spaced forked end portions positioning the wheel axles higher above the ground;

FIG. 7 is a partial exploded view showing a brake components mounting bracket and brake components about to be pre-assembled as they are so shown pre-assembled in FIG. 6;

FIG. 8 is a partial enlarged view of portions of the brake components mounting bracket, the hydraulic fluid line, and hydraulic fitting, secured to the hydraulic line to hydraulic cylinder fitting, inturn secured to the hydraulic cylinder, indicating the interior passageway for the hydraulic fluid;

Figure 3:
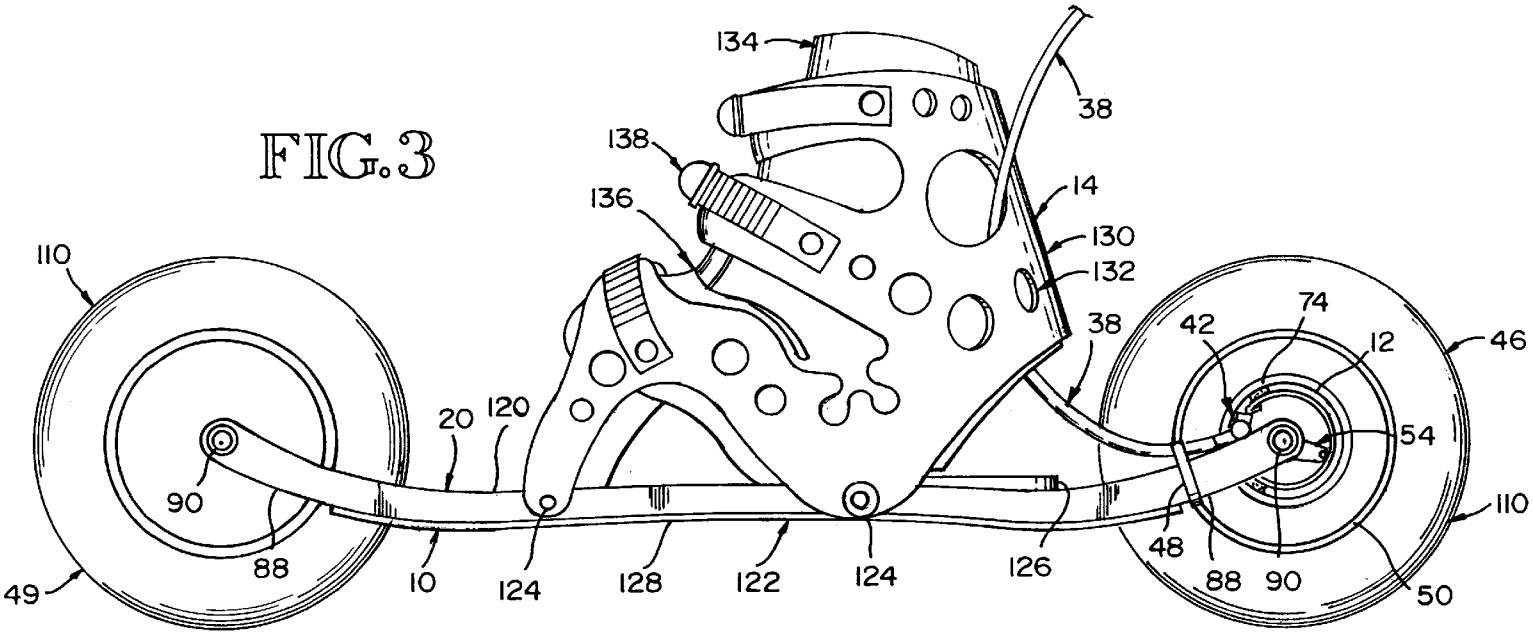

FIG. 11 is a partial rear perspective view of portions of the wheeled skate-ski to illustrate: an installed removable mud flap, which is attached to the firm outer shell of the binding; a heel lift or cant adhered to the chassis; the softer inner liner; and a size adjustment locale of the outer firm's shell of the binding; and FIG. 12 is an enlarged partial rear perspective view of portions of wheeled skate-ski to illustrate: how the mud flap is secured to the firm outer shell of the binding; the positioning of a heel lift or cant; and the pre-locating of protective strips to be adhered to the underside edge of the bottom of the chassis, as they are so shown in FIG. 3.

DESCRIPTION OF PREFERRED EMBODIMENT

Introduction Regarding Using these Wheeled Skate-Skis

As noted previously in the writing, this application pertains to improvements and to changes related to the wheeled skate-skis illustrated and described in the U.S. Pat. Nos. 4,943,075 and 5,251,934. These wheeled skate-skis 10 with brakes 12 are readily usable on most terrains.

Figure 1:
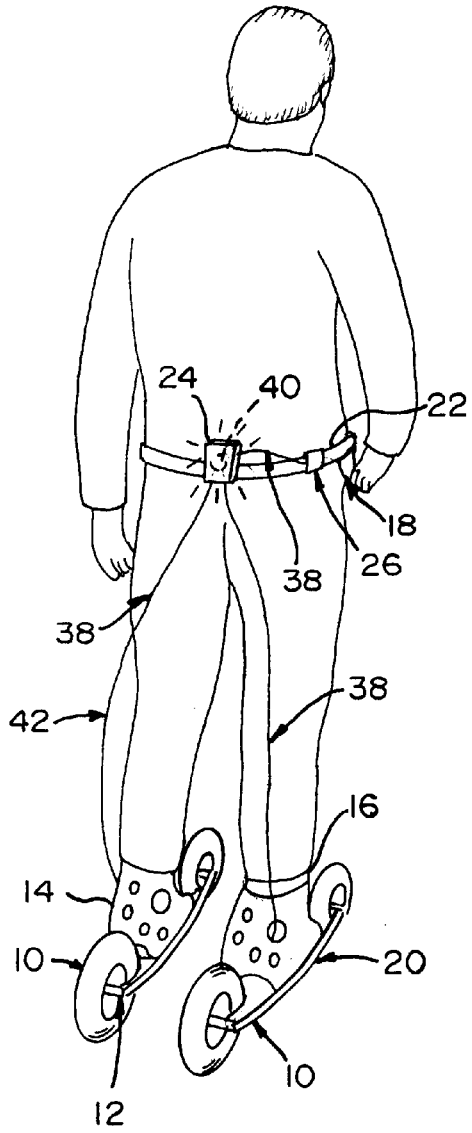

In FIG. 1, a sportsperson is shown, from the rear, as she or he is ready to go, having firmly positioned and supported her or his feet, with athletic shoes 16 on, to these wheeled skate-skis 10, using the adjustable bindings 14. Then with the hand control 18 for the brakes 12 conveniently positioned and ready for actuation, she or he is ready to get underway.

Figure 2:
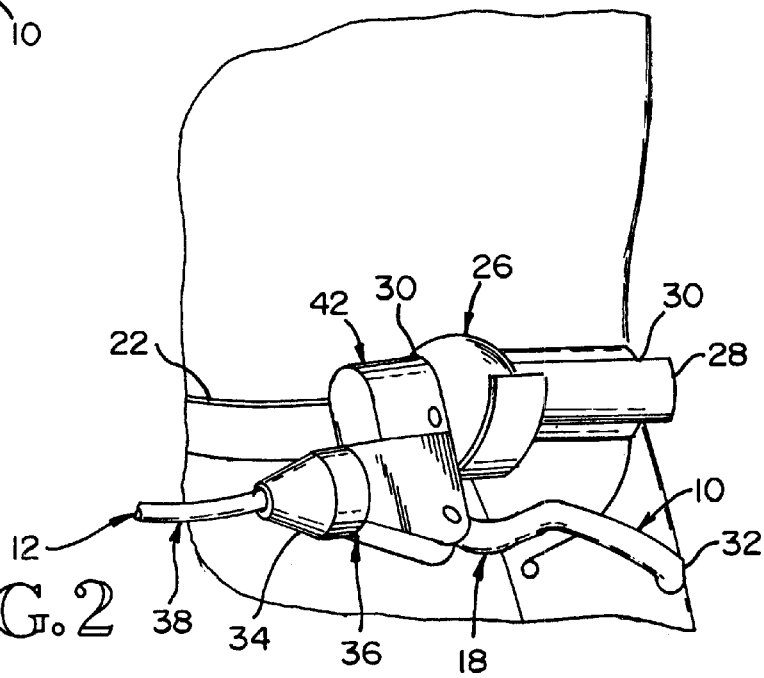

A belt 22 is provided to support components of the brakes 12, as shown in FIGS. 1 and 2. Preferably and optionally a flashing red light 24 is provided centrally on the back of the belt 22. She or he will turn this light on, when necessary to increase other persons ability to observe her or him.

As a sportsperson coasts down a grade of terrain, when the speed increases, she or he, will be changing their body positions by lowering their center of gravity and leaning forward. At all times going downhill the hand control 18 for the brakes 12 is conveniently held and ready to operate to apply braking forces to both wheeled skate-skis to slow down and/or to stop. During braking operations, because of the convenience of the had control for controlling the braking forces, the sportsperson remains in the most stable selected body positions for safely keeping her or his balance.

When the coasting is completed, and additional traveling is to be undertaken on level ground or on an incline, then the sportsperson commences and uses skating motions to gain headway. During this time, the sportsperson may support the hand control 18 for the brakes completely on the belt 22, in a position where he or she may quickly reach the hand control 18 to operated the brakes 12.

The wheeled skate-skis 10 are provided in sizes, with respect to both overall length and the size of the adjustable binding 14 to accommodate a range of foot sizes and weights of respective sportspersons, or other persons traveling during their daily routines, often including riding times on buses, for example. Each general size of a wheeled skate-skis 10, such as for example, small, medium, or large, has in turn a binding which is adjustable to receive and secure several sizes of a person's shoes.

The Brakes Are Provided in an Overall Hydraulic Braking Assembly Providing Braking Performance in Comparison with Braking Performance of a Roadway Motor Vehicle The sportsperson using these wheeled skate-skis confidently uses the hand control 18 knowing the braking power she or he is selecting at various power levels in slowing down, and eventually slowing down to stop will always be available. There is no fading of braking power due to over heating, and/or insufficient braking surfaces, or lowering of the range of the hydraulic pressure actuator.

As illustrated in FIGS. 1 and 2 the hand control 18 for operating the brakes is either held in hand of the sportsperson or removably secured to the belt 22, preferably by using a hook and loop fastener 26. This hand control 18 is or is like a hand control now used on bicycles. A handle 28 for holding this hand control 18 is inserted into a hollow cylindrical portion 30 of the bicycle hand control, in the volume which otherwise would receive a portion of the bicycle handle bar. This handle 28 is either directly gripped in the sportsperson" hand as shown in FIG. 1, or is secured to the belt 22 by the hook and loop fastener 26. In this latter position on the belt 22, the sportsperson still is available to operate the hand control 18.

As shown in FIG. 2, the brake lever 32, via spring force, is spaced away from the handle 28, until the sportsperson's fingers grip it for creating brake applying forces. Inside the housing 34 of this hand control 18 for actuating the brakes is a hydraulic cylinder and piston combination, not shown. The piston is moved in proportion to the pivotal movement of the brake lever 32. The piston movement, inturn, creates a pressure change in the hydraulic fluid, not indicated, contained within the respective hydraulic fluid lines 38. This housing 34 and interior components thereof are referred to as the hand lever/brake master cylinder 36.

As illustrated in FIGS. 1 and 2, a hydraulic fluid line 38 leaves the housing 34 of this hand control 18 and is directed along the belt 22 to the center of the back of the sportsperson. Enroute, the hydraulic fluid line 38 may be positioned along the belt 22 by using a hook and loop fastener 26. At this center of the back location the hydraulic fluid line 38 is secured, while entering a hydraulic tee fitting 40, which is removably secured to the belt 22. Then, preferably, as shown in FIG. 1, a flashing light assembly 24, is removably secured to the hydraulic tee fitting 40, or located closely to it in this center of the back location.

Two hydraulic fluid lines 38, secured to the hydraulic tee fitting 40, are extended downwardly, therefrom along the back of the respective legs of the sportsperson to reach the locale of the additional hydraulic breaking system 42 components mounted on the respective wheeled skate-skis 10, as shown in FIG. 1. Enroute these hydraulic fluid lines 38 may be removably fastened about the respective legs of the sportsperson.

Figure 4:
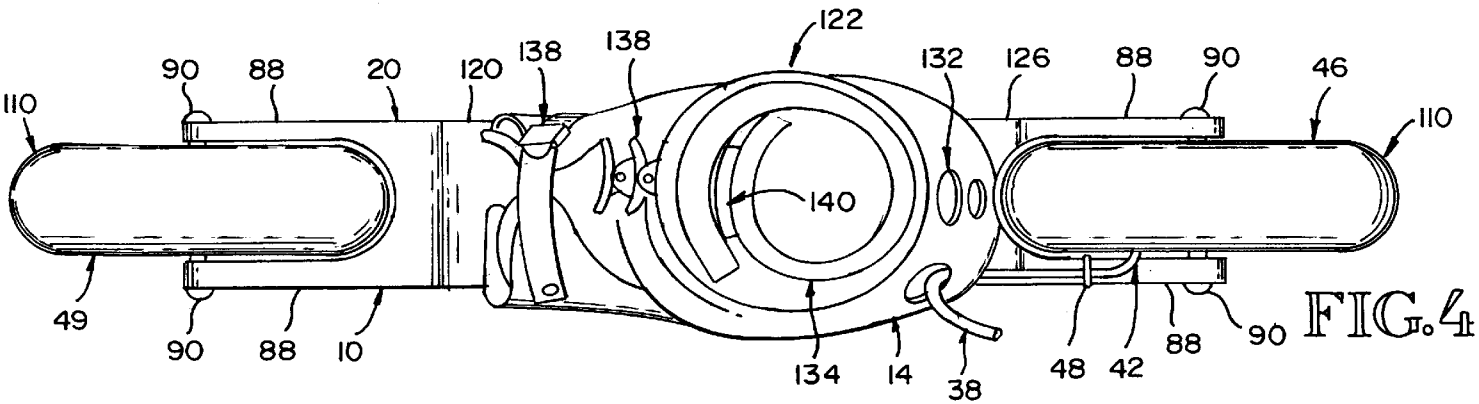
FIG. 4 is a top view of the wheeled skate-ski which shows the softer inner liner and how portions of it overlap, and are then held in the selected overlapped position by using a hook and loop fastener.

At the respective locales of the wheeled skate-skis 10, the respective hydraulic fluid lines 38, as illustrated in FIGS. 3 and 4, are directed into and out of the bindings 14 for controlling their positioning enroute to a respective rear wheel assembly 46. Just before reaching a respective rear wheel assembly 46, each hydraulic fluid line 38 is directed to be adjacent to a portion of the chassis 20, and it is kept in this position by a removable positioning means 48 to keep the hydraulic fluid line 38 clear of the respective revolving wheel 50.

Figure 5:
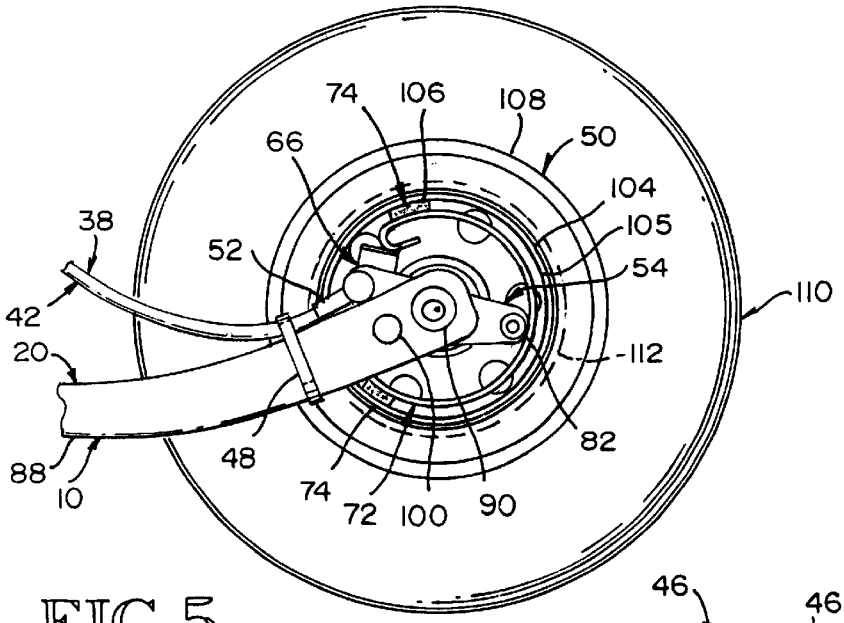
FIG. 5 is an enlarged partial view illustrating the assembly of the hydraulic fluid components located at the rear end of the chassis of a wheel skate-ski at the locale of the rear wheel assembly.

How the changes in the hydraulic fluid pressure, initiated by the hand movements of the sportsperson, using the hand control 18 for applying braking forces, are utilized at the locale of the rear wheel assembly 46, is illustrated throughout FIGS. 5 through 10. The arrival and connection of a hydraulic fluid line 38 at a respective rear wheel assembly 46 is shown in FIG. 5, where its hydraulic fitting 52, is secured.

Figure 6:
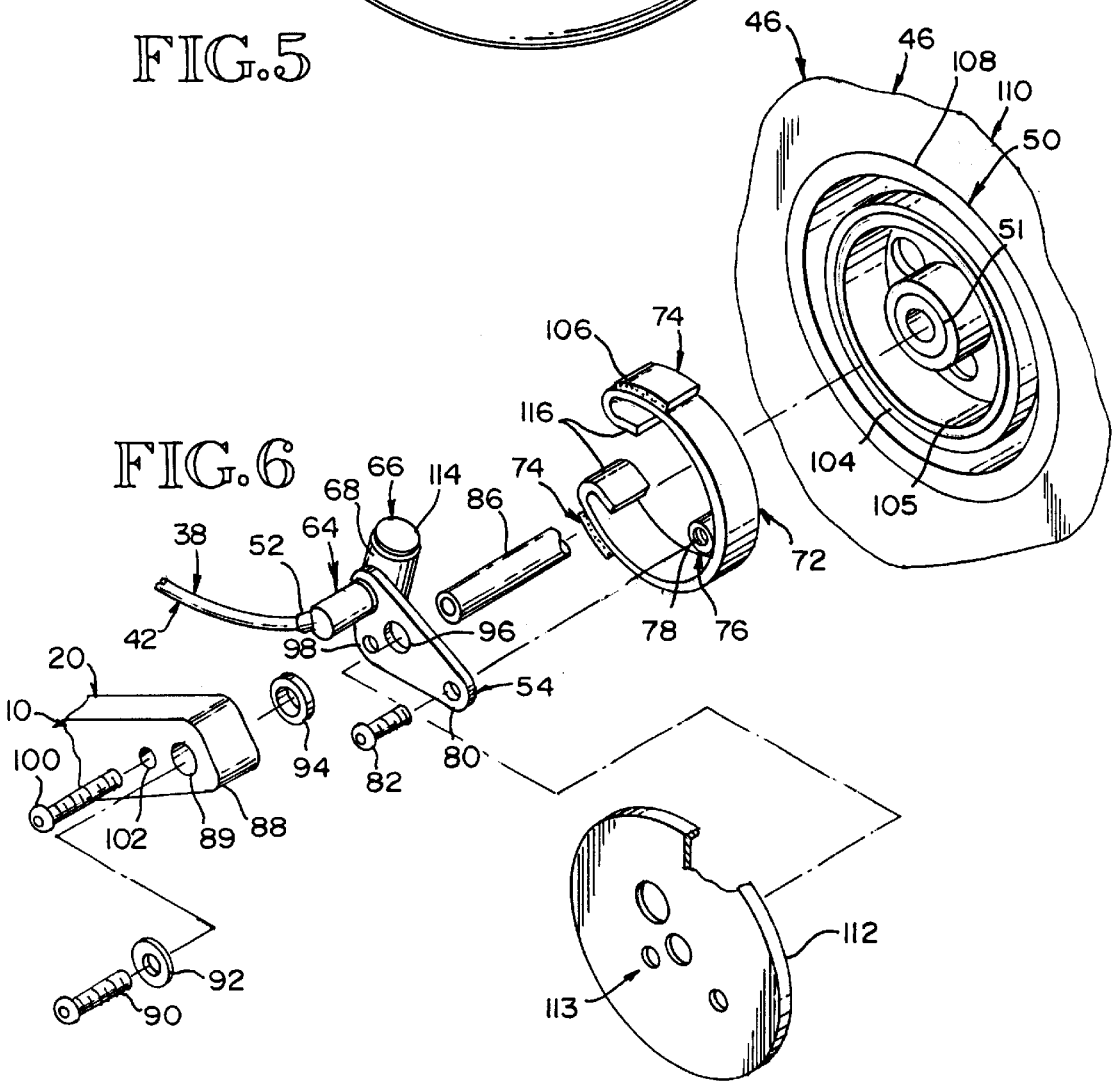
FIG. 6 is an exploded view showing the relative positioning of components and a pre-assembly of some components in respect to the hydraulic fluid components located at the rear end of the chassis of a wheel skate-ski, which are all shown assemble in FIG. 5.

At this locale of the rear wheel assembly 46 the pre-positioning of the various brake components of the hydraulic braking system 42, and portions of the chassis 20 and the rear wheel assembly 46 are illustrated in the exploded perspective view of FIG. 6. As shown in FIG. 7, a brake components mounting bracket 54 has four holes. Three are circular openings. The fourth 56 has a straight locating or indexing portion 58 interrupting the circular portions 60.

This locating or indexing portion 58 receives a matching indexing portion, 62 on a fitting 64 which passes through the fourth hole 56 in the brake components mounting bracket 54. This fitting 64 is secured at one end to the hydraulic fitting 52, inturn connected to the hydraulic fluid line 38, and then at the other end to a brake cylinder assembly 66. The use of these indexing portions 58 62 insures, at the time of the final assembly, that the hydraulic fluid line 38 is initially directed adjacent to the chassis 20, as shown in FIG. 5.

This fitting 64 serving to position and to connect the hydraulic fluid line 38 with its hydraulic fitting 52 to the brake cylinder assembly 66, while all three are then positioned by the brake components mounting bracket 54, is called the hydraulic line to hydraulic cylinder fitting 64, as the hydraulic fluid passageway 65 is continued through this fitting 64, as shown in FIGS. 7 and 8. This fitting 64 is further retained by a snap ring 69 fitted to its groove 70.

The utilization of the other three completely circular holes of the brake components mounting bracket 54, are illustrated by viewing FIGS. 5, 6, and 7. FIG. 5, indicates the final positioning. FIG. 7 indicates the brake components mounting bracket 54 with the four respective holes. FIG. 6 indicates the pre positioning of all the parts before assembly.

The hydraulic line to hydraulic cylinder fitting 64, in FIG. 6 is shown as preassembled with hydraulic fitting 52, the brake components mounting bracket 54, and the hydraulic cylinder 68 of the bake cylinder assembly 66. The hydraulic fitting 52, may optionally, be provided as a quick disconnect hydraulic fitting 52.

Subsequently, the sole, resilient, curved, spring brake shoe 72, with the brake lining 74 located respectively at each free end of the sole, resilient, curved, spring, brake shoe 72, and with its integral brake shoe mounting boss 76, having a threaded hole 78, is also pre-positioned on the bracket components mounting bracket 54 using a smaller circular hole 80 and a threaded bolt 82, as shown in FIG. 6. Then as indicated in FIG. 6, the axle 86 controls the positioning of the rear wheel 50, the brake components mounting bracket 54 and its pre-mounted components, with the two spaced rear end fork portions 88 of the chassis 20, which extend on the respective sides of the rear wheel assemble 46, with only one of these space rear end portions being shown in FIG. 6. A receiving hole 89 in rear end portion 88 of the chassis 20 receives a respective axle end. The respective side locations of a respective group of a fastener 90, washer 92 and a spacer 94 serve to secure together the axle 86, the rear wheel assembly 46, and the brake components mounting bracket 54, via its larger hole 96, with its pre-mounted components. The fastener 90 is passed through the washer 92, the receiving hole 89, the spacer 94, the larger hole 96, and threaded into the axle end.

During this assembly, using the axle 86, the brake components mounted bracket 54, via its other smaller circular hole 98, which is threaded, receives the threaded bolt 100 passing through the hole 102 in the spaced rear end fork portion 88. With this bolt 100 in place, this bracket 54 is prevented from rotating and the sole, resilient, curved, spring brake shoe 72, therefore stays in the initial position.

Each of the rear wheel assemblies 46, in respect to a respective rear wheel 50 has a bearing 51 and a brake drum 104, to receive the sole, resilient, curved, spring brake shoe 72, with its two rectangular pads 106 of the brake lining 74. If the rear wheel 50 with its integral brake drum 104 is made of material which might not wear too well, then a stainless steel ring 105 is press fitted or molded into place to provide a longer lasting brake drum friction surface structure in the rear wheel 50, as shown in FIGS. 5 and 6. Also each rear wheel 50 has a receiving rim 108 on which a pneumatic tire assembly 110 is mounted. Similar pneumatic tire assemblies 110 are mounted on the front wheels 49. The tire may be tubeless or may be used with an inner tube. As shown in FIG. 6, an optional cover 112 may be included in the assembly to keep debris out of the hydraulic braking system 42. It has a group of holes 113 to accommodate the passageway of other components during assembly.

Figure 9:
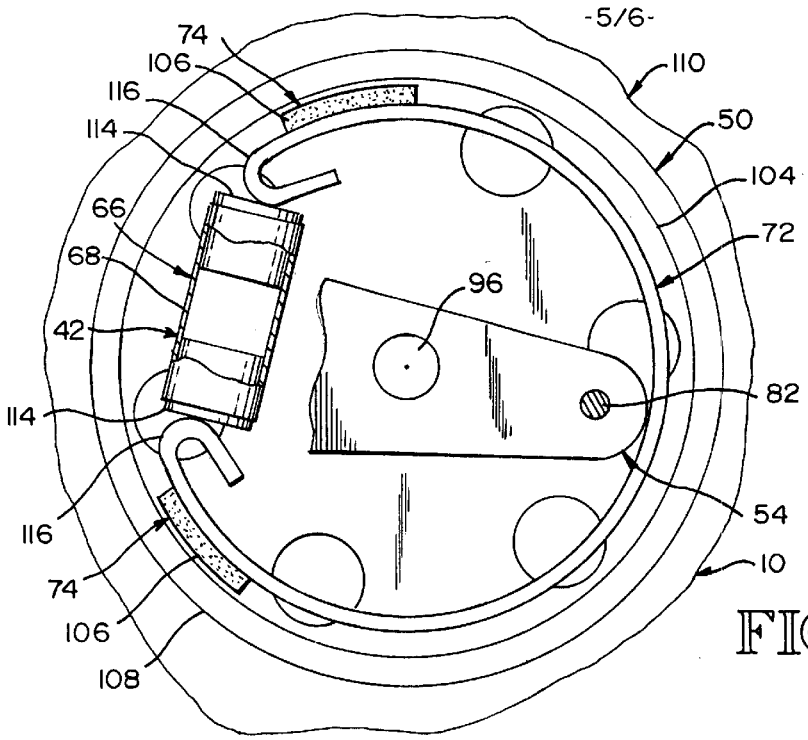
FIG. 9 is a partial enlarged side view of the hydraulic fluid braking system components which are positioned in the rear wheel assembly, and the brakes are not being applied.
Figure 10:
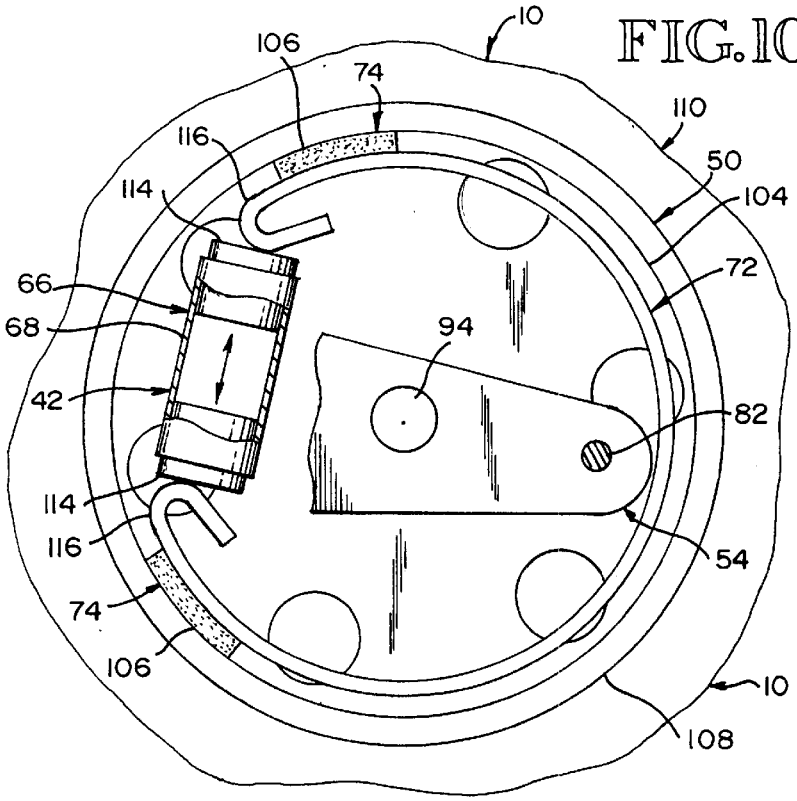
FIG. 10 is a partial enlarged side view, similar to FIG. 9, however, showing the positioning of the components of the hydraulic fluid braking system components in the rear wheel assembly, when the brakes are being applied.

After this assembly, the hydraulic braking system 42, with the hydraulic fluid included in this system 42, is ready to be operated. In respect to what happens when the hand control 18 is moved by a sportsperson's hand and finger movements, in reference to FIGS. 9 and 10, the before braking movements, and after braking movements of respective positions of the brake components located at the rear wheel locale are respectively illustrated in the FIGS. 9 and 10. In FIG. 9, the cross section, shows the hydraulic cylinder 68, broken away in part, indicating the non braking positions of the respective pistons 114 of the brake cylinder assembly 66. Then in FIG. 10, the cross section, shows the hydraulic cylinder 68 broken away in part, indicating braking positions of the respective pistons 114 of the brake cylinder assembly 66. The arrows represent the hydraulic fluid pressure created opposing forces moving the respective free ends 116 of the brake shoe 72, in turn pressing the rectangular pads 106 of the brake lining 74 into braking contact with the brake drum 104 of the rear wheel 50 of the wheeled skate-skis 10.

When the sportsperson's hand and finger movements are changed to reduce and/or eliminate the braking force, then the sole, resilient, curved, spring brake shoe 72 commences its resilient spring return to its initial starting configuration. If the braking force is to be eliminated, the resilient, curved, spring, brake shoe 74 returns to its initial starting configuration and position. The rectangular pads 106 of the brake lining 74 are then cleared away from the rear wheel 50.

As observed in FIGS. 5,6,9, and 10, the sole, resilient, curved, spring, brake shoe 72, is preferably curved in a partial circular arc. At the midpoint of the circular arc, the sole, resilient, curved, spring, brake shoe 72 is firmly secured. At the respective free ends thereof, the circular arc portions are turned back and under. At these locales the outside of each free end supports a respective brake pad 74. The inside of each free end provides a contact surface to receive the moving contact of a respective piston 114, during the application of the hydraulic brakes.

During the braking action, only the respective brake pads 74 are contacting the respective brake drums 104. The spring material selected for forming the sole, resilient, curved, spring, brake shoe 72, insures the return of the respective free ends to their non braking positions to clear the brake pads 74 from the brake drums 104.

The Chassis Is Formed with a Foot Receiving Body Portion Having a Built in Convex Camber to Provide a Spring-Like Suspension Under the Weight of a Sportsperson, and with Upwardly Directed Curved Forked Ends to Position the Wheel Axles Higher Above the Ground Thereby Lowering the Overall Center of Gravity of the Sportsperson Using Her or His Pair of Wheeled Skate-skis As illustrated in FIG. 3, the chassis 20 of each wheeled skate-ski 10 has a foot receiving body portion 120, which has a built in convex camber 122. When the sportsperson is underway on the wheeled skate-skis 10, he or she receives the benefit of the inherent spring-like suspension provided in the manufactured chassis 20. The material or materials selected to be used in a selected manufacturing process to produce a respective chassis 20, insure, when a person's weight is removed the chassis 20 returns to the original convex camber 122, and during the presence of a person's weight sufficient convex camber 122 remains to provide the spring like suspension at all times.

Also the chassis 20, has the respective front and back ends formed with upwardly directed curved forded ends 88. When the axles 86, with the front wheel assembly 49 and rear wheel assembly 46, are respectively positioned and secured in place between these upwardly directed curved forked ends 88, the positioning result achieved is the lowering of the overall center of the gravity of the sportsperson using his or her pair of these wheeled skate-skis 10.

This chassis design may be manufactured by several processes using selected materials while maintaining low weight and high strength characteristics. Depending on process and materials used a box construction having inherent strength is continued throughout the foot receiving body portion 120 and the forked ends 88 in some embodiments of the wheeled skate-skis 10.

Some of the selected materials are plastic closed-cell foam products, honeycomb products, and wood for core materials. Other products or materials are carbon fiber, kevlar, and fiberglass with epoxy resins. Some of the processes are wet lay-up, resin transfer molding with a dry lay-up, and compression molding with resin pre-impregnated composite materials. Various layers of composite fabrics, based on their respective qualities are arranged at key stress locations to optimize strength and performance of the finished chassis 20. Other processes used are urethane injection molding with braided composite fabrics, and composite blow molding of cores in other processes.

There are no resulting sharp corners nor sharp edges in any resulting chassis 20, when using these selected materials and employing these selected processes.

Where attachment fasteners 124 are to be used with the chassis 20, such as those used in securing the bindings 14, threaded units are, in part molded into the chassis 20, or are later with some machining, fitted into the chassis, thereafter receiving additional parts of the fasteners 124.

The chassis 20 is conveniently fitted, when desired, with heel lifts 126 and/or cants 126 per specifications unique to a sportsperson who will be using the wheeled skate-skis 10, as illustrated in FIGS. 3, 4, 11, and 12.

On a selected chassis 20, or on all chassis 20, strips 128 of abrasion resistant highly durable material are added along the bottom side edges of the chassis 20, as shown in FIGS. 3 and 12. These strips have sufficient area to protect the chassis 20: during harsh off-road conditions; while sliding over concrete curbs; and other, otherwise, damaging obstructions. The strips 128 are either molded in to the chassis 20, mechanically fastened, or subsequently adhered using a reliable adhesive. Often the strips 128 are made of ultra high molecular weight polyethylene material.

The Binding Is a Combination of an Outer Shell of Firm Material, Adjustable in Size by Adjusting Fasteners; and of an Inner Liner of Soft Material Arranged in an Adjustable Partially Overlapping Foot and Ankle Comfortable Cover, Utilizing Hook and Loop Fasteners The bindings 14, illustrated in FIGS. 1, 3, 4, 11, and 12, are adjustable to fit athletic shoes 16 of several sizes, with a selected size to be worn by a respective sportsperson, as she or he places her or his respective foot into an opened binding 14, and then subsequently tightens the binding about the selected size athletic shoe 16. Each binding 14 is a combination of an outer shell 130 of firm material formed with several openings 132 of different sizes, and an inner liner 134 of soft material, with selective openings 136. Preferably, the inner liner 134 is made of a foamed plastic material.

An outer shell 130 may be formed using ultra high material weight plastic material in an injection molding process. Other materials may be thermo formed. Then some materials may be first cut, while arranged as a planar materials, and thereafter, shaped into an outer shell 130. Inner liners 134 may be made by either molding, forming, or cutting and shaping.

The outer shell 130 has fasteners 138 which preferably are straps equipped with lightweight ratchet buckles, as illustrated in FIGS. 3 and 4. The inner liner 134 is preferably overlapped and secured by hook and loop fasteners 140.

Preferably, as shown in FIGS. 11, on one front lower side location 142 of the outer shell 130, there are selected fastener receiving holes 144 in a folded under tab 146 of this outer shell 130. This arrangement provides another size adjustment of the outer shell 130, when a threaded fastener 148 is passed through a selected hole 144 and threaded into a secured threaded insert portion of the fastener 148 which is located in the chassis 20 by this front lower side location 142. The bindings 14 are primarily secured to the sides of the chassis 20, leaving the top surface of the chassis 20 for the direct receiving contact of the sole of the person's selected shoe.

When Necessary Removable Mud Flap is Installed Via a Snap in Positioning on the Outer Shell of a Binding, to Deflect Water, Mud, and Other Debris Away from the Sportsperson A sportsperson enjoying his or her utilization of these wheeled skate-skis 10 may on occasions be using them during wet weather conditions. During these conditions rain water, mud, and other debris could be thrown back against the sportsperson. Therefore, mud flaps 150 are provided as illustrated in FIGS. 11 and 12.

Preferably, the mud flap 150 is a removable mud flap 150 having respective spaced insertable interconnecting grip like formed ends 152, integrally projecting from the curved fender-line portion 154, which extends rearwardly over the rear wheel 50 and pneumatic tire assembly 110. The removable mud flap 150 is preferably made of the same material as the material used in making the outer shell 130 of the binding 14. This material is typically an ultra high molecular weight polyethylene material.

The mud flap 150, via its shape, is sufficiently resilient and flexible to be snapped into and out of engagement with the outer shell 130. This is accomplished by inserting its respective spaced insertable interconnecting grip like formed ends 152 into and out of selected spaced openings 132 formed in the outer shell 130, as shown in FIGS. 11 and 12.

The Varied Times of the Utilization of these Pair of Wheeled Skate-Skis with Brakes Usable on Most Terrains Although the user of these pair of wheeled skate-skis 10 has been referred to as a sportsperson, some users may not regard themselves as sportspersons, but instead just users needing a better way of getting them about during their daily activities. They may skate-ski about their neighborhood, or go shopping, visit friends, just exercise, or go to a location to work or perform other useful activities, such as attending sporting events and cultural events.

Enroute, the user may remove her or his wheeled skate-skis 10 and carry them onto a vehicle, such as car, truck, bus, train, or boat. Then upon reaching a destination, the wheeled skate-skis 10 may be securely stored while the user accomplishes her or his activities. Or, if the first destination is only a stop when using such vehicles, then the user again uses the wheeled skate-skis 10 to reach another location.

At all times during her or his use of the wheeled skate-skis 10, she or he will know they will be comfortably and reliably supported, and very importantly they know they are able to safely slow down and stop when they want to at anytime.

I claim:

1. An assembly of a pair of wheeled skate-skis with one hand and fingers operated hydraulic braking system for use on most terrains: comprising a) each of the wheeled skate-skis of this assembly, comprising:

i) a chassis having a foot receiving body portion, with fastener receiving holes, two upwardly curved two spaced forked ends, one at each end of the chassis, each one having axle receiving holes and other receiving holes;

ii) a binding secured by fasteners to the foot receiving body portion of the chassis;

iii) fasteners for securing the binding to the chassis;

iv) a front wheel assembly, having an axle and fasteners, positioned on the chassis using the axle receiving holes and the fasteners; and v) a rear wheel assembly, having an axle and fasteners, positioned on the chassis using the axle receiving holes and the fasteners, and also having a brake drum sized cylindrical receiving volume to accommodate some of the components of a hydraulic braking system; and b) a hydraulic braking system of this assembly, comprising:

i) a hand and fingers operated control to apply, change, and release hydraulic fluid pressure, having a housing, a handle extending from the housing, a cylinder and piston positioned in the housing, serving as a brake master cylinder, a pivotable lever for moving the piston and positioned by the housing, and an attachment location on the housing to receive a hydraulic fluid line;

ii) a subassembly of some components of the hydraulic braking system located at the rear wheel assembly: having in the brake drum sized cylindrical receiving volume, a brake drum, a sole, resilient, curved, spring brake shoe, with two respective free ends, brake lining arranged in two pads on the respective two free ends, brake cylinder assembly of two pistons within a cylinder, a portion of a fitting, having a fluid passageway, connected to the brake cylinder assembly, and the remaining portion extending out of this receiving volume, serving as an attachment location to receive a hydraulic fluid line, and having, in addition, outside and adjacent to this receiving volume, a brake components mounting bracket mounted about the axle of the rear wheel assembly; to position the fitting having the fluid passageway; to receive a fastener for securing the brake shoe to this brake components mounting bracket; and to receive a fastener for positioning this brake components mounting bracket in a non rotating location adjacent to a fork end position of the chassis;

iii) a hydraulic fluid line assembly; having portion of a hydraulic fluid line extending from the hand and finger operated control to a waist high center back locale of a person when she or he would be using the wheeled skate-skis; a hydraulic tee to receive this portion of the hydraulic fluid line; two like portions of a hydraulic fluid line, each extending from the hydraulic tee and on to the fitting having the fluid passageway connected to the brake cylinder assembly located at the rear wheel assembly; and two alike hydraulic fittings, each used to connect the respective hydraulic fluid line extending from the hydraulic tee to the fitting having the fluid passageway connected to the brake cylinder assembly, thereby completing the hydraulic fluid line assembly of this assembly of a pair of wheeled skate-skis with hand operated hydraulic brakes.

2. An assembly of a pair of wheeled skate-skis with one hand and fingers operated hydraulic braking system, for use on most terrains, as claimed in claim 1, wherein the binding secured by fasteners to the foot receiving body portion of the chassis, comprises:

a) an outer shell made of firm material, having spaced holes and cutouts, so the outer shell is readily positioned on the chassis, and also readily adjusted in fitting the binding to a person's shoe, and having fasteners used to keep the outer shell in position when the wheeled skate-skis are being used; and b) an inner liner made of soft material, having a cutout and overlapping portions positioned inside the outer shell and readily adjusted in fitting the binding to a person's shoe, and having a fastener used to keep the overlapping portions positioned when the wheeled skate-skis are being used.

3. An assembly of a pair of wheeled skate-skis with one hand and finger operated hydraulic braking system for use on most terrains, as claimed in claim 2 wherein the chassis has the body portion formed on a convex camber and made of materials which are flexible, under the weight of a person, thereby providing a spring like suspension.

4. An assembly of a pair of wheeled skate-skis with one hand and fingers operated hydraulic braking system for use on most terrains, as claimed in claim 3, comprising in addition:

a mud flap for removable attachment to the outer shell of the binding to deflect water and debris away from the person using the wheeled skate-skis, integrally comprising:

i) a fender portion; and ii) two spaced ends extending from the fender portion for insertion into respective holes of the outer shell, supporting the fender in a position to deflect water and debris.

5. An assembly of a pair of wheeled skate-skis with one hand and fingers operated hydraulic braking system for use on most terrains, as claimed in claim 2, comprising, in addition:

a mud flap for removable attachment to the outer shell of the binding to deflect water and debris away from the person using the wheeled skate-skis, integrally comprising:

i) a fender portion; and ii) two spaced ends extending from the fender portion for insertion into respective holes of the outer shell, supporting the fender in a position to deflect water and debris.

6. An assembly of a pair of wheeled skate-skis with hand and fingers operated hydraulic braking system for use on most terrains, comprising:

a) each of the wheeled skate-skis of this assembly, comprising:

i) a chassis made of resilient material having a foot, with a shoe on, direct receiving body portion, formed on a convex camber, which remains convexed and flexible under the weight of a person, thereby providing a spring like suspension, fastener receiving-holes in said body portion along the sides thereof, two integral upwardly curved ends extending from the said body portion, each of the said curved ends having integral spaced forked ends, each said spaced forked end being thereby located at a respective raised end of the said chassis, each said spaced forked end having axle receiving holes and other receiving holes located higher than the said body portion, serving to subsequently position a person lower down;

ii) a binding secured by fasteners to the chassis using the fastener receiving holes in the said foot, with a shoe on, direct receiving body portion formed on a convex camber, comprising:

an outer shell made of firm material, having spaced holes and cutouts, the said fasteners securing this said outer shell to the chassis, and having adjustable spaced buckle fasteners; and an inner liner made of soft material having holes, the said fasteners securing this said inner liner to the chassis, and having overlapping portions, positioned inside the said outer shell, and readily adjusted in fitting the binding to a person's shoe, and having a hook and looped fastener to keep the said overlapping portions positioned, at a later time, when the wheeled skate-skis are being used, as the said spaced buckle fasteners are also comfortably adjusted to secure the said binding to a person's shoes;

iii) fasteners for securing the said binding to the chassis, iv) a front wheel assembly, having a wheel, a pneumatic tire, an axle, fasteners, positioned on a respective said spaced fork end of the said chassis using the axle receiving holes and the said fasteners; and v) a rear wheel assembly, having a wheel, a pneumatic tire, an axle, fasteners, positioned on the other respective said spaced fork end of the said chassis, said wheel having a brake drum, and a brake drum cylindrical receiving volume to accommodate some of the components of a hydraulic braking system; and b) a hydraulic braking system of this assembly, comprising:

i) a hand and finger held and operated control to apply, change, and release hydraulic fluid pressure, having a housing, a handle extending from the housing, cylinder and piston positioned in the housing, serving as a brake master cylinder, a pivotable lever for moving the piston and positioned by the housing, and an attachment location on the housing to receive a hydraulic fluid line;

ii) a subassembly of some components of the hydraulic braking system located at the rear wheel assembly, having, positioned inside the said brake drum sized cylindrical receiving volume: a brake drum of a wheel, a sole, resilient, curved, spring, brake shoe, curved in a partial circular arc, secured in position at the midpoint of the said partial circular arc, the free ends of the said partial circular arc are turned back and under, and these said free ends on the outside thereof position a brake pad, and on the inside thereof provide a contact surface to receive a contact of a respective piston during an application of the hydraulic brakes; brake pads secured to the said respective free ends; a hydraulic brake cylinder assembly of two opposed pistons within a cylinder; a fitting, having a portion thereof in the said brake drum sized cylindrical receiving volume and having a fluid passageway connected to the said hydraulic brake cylinder assembly and the remaining portion of the said fitting having the said fluid passageway extending out of the said brake drum sized cylindrical receiving volume serving as an attachment location to receive a hydraulic fluid line, and having, positioned outside and adjacent to the said brake drum sized cylindrical receiving volume: a brake components mounting bracket with a hole to receive an axle and mounted about the said axle of the said rear wheel assembly, with another hole to position the said fitting having the fluid passageway, with another hole to receive a fastener to secure the said sole, resilient, curved, spring, brake shoe to this said brake component's mounting bracket, another hole to receive a fastener for securing this said brake component's mounting bracket adjacent to a said forked end of a said chassis in a location to prevent the rotation of this said brake component's mounting bracket, a fastener to secure the said sole, resilient, curved, spring, brake shoe at the said midpoint of the said partial circular arc thereof, using a hole thereof, to the said brake component's mounting bracket in a non rotatable position, a fastener to secure the said brake component's mounting bracket adjacent to and to the said forked end of the said chassis in a location to prevent the rotation of the said brake components mounting bracket.

iii) A hydraulic fluid line assembly: having a portion of a hydraulic fluid line extending from the hand and finger operated control to a waist high center back locale of a person when she or he would be using the wheeled skate-skis; a hydraulic tee to receive this portion of the hydraulic fluid line; two like portions of a hydraulic fluid line, each extending from the hydraulic tee and onto the fitting having the fluid passageway connected to the brake cylinder assembly located at the rear wheel assembly; and two alike hydraulic fittings, each used to connect the respective hydraulic fluid line extending from the hydraulic tee to the fitting having the fluid passageway connected to the brake cylinder assembly, thereby completing the hydraulic fluid line assembly of this assembly of a pair of wheeled skate-skis with hand operated hydraulic brakes.

7. An assembly of a pair of wheeled skate-skis with one hand and fingers operated hydraulic braking system for use on most terrains, as claimed in claim 6, comprising in addition:

a) A mud flap for multiple on and off removable attachment to the outer shell of the binding to deflect water and debris away from the person using the wheeled skate-skis, integrally comprising:

i) a resilient fender portion; and ii) two spaced integral, resilient ends extending from the resilient fender portions for snap-in insertion into respective holes of the outer shell, supporting the mud flap in a position to deflect water and debris.

* * * * *